United States Patent [19]

DiLeo

[11] 4,135,717

[45] Jan. 23, 1979

[54] TENNIS RACQUET WITH INSERT

[76] Inventor: Philip F. DiLeo, P.O. Box 388, Boulder, Colo. 80302

[21] Appl. No.: 626,510

[22] Filed: Oct. 28, 1975

Related U.S. Application Data

[63] Continuation-in-part of Ser. No. 567,922, Apr. 14, 1975, abandoned.

[51] Int. Cl.[2] ..... A63B 49/02

[52] U.S. Cl. ..... 273/73 L

[58] Field of Search ..... 273/73 R, 73 C, 73 D, 273/74, 79, 73 E, 73 H, 73 L; 280/603; 294/57

[56] References Cited

U.S. PATENT DOCUMENTS

| | | | |
|---|---|---|---|
| 1,568,485 | 1/1926 | Turney | 273/79 |
| 1,832,298 | 11/1931 | Greenspan | 273/73 C X |
| 2,004,609 | 6/1935 | Johnston | 273/73 L X |
| 3,546,751 | 12/1970 | Baso | 273/73 E X |
| 3,689,093 | 9/1972 | Meland | 273/73 R X |
| 3,707,288 | 12/1972 | Edlefsen | 273/73 L |
| 3,843,121 | 10/1974 | Edlefsen | 273/73 L |
| 3,891,211 | 6/1975 | Diefenbach | 273/73 L |

FOREIGN PATENT DOCUMENTS

| | | | |
|---|---|---|---|
| 151916 | 6/1953 | Australia | 273/73 L |
| 208945 | 7/1957 | Australia | 273/73 C |
| 1903722 | 8/1970 | Fed. Rep. of Germany | 273/73 L |
| 1489007 | 6/1967 | France | 273/73 C |
| 386550 | 1/1933 | United Kingdom | 273/74 |
| 427265 | 4/1935 | United Kingdom | 273/74 |
| 1050631 | 12/1966 | United Kingdom | 273/74 |

*Primary Examiner*—Richard J. Apley

[57] ABSTRACT

A racquet having a replaceable playing surface. The racquet includes a one-piece solid frame having a handle and a head. The head is provided with an arcuate opening with a groove for receiving an insert. The insert has a rim with a playing surface secured fixedly therein, a spring lever attached to wires which have locks which provide for locking and unlocking of the insert within the head of the racquet.

6 Claims, 4 Drawing Figures

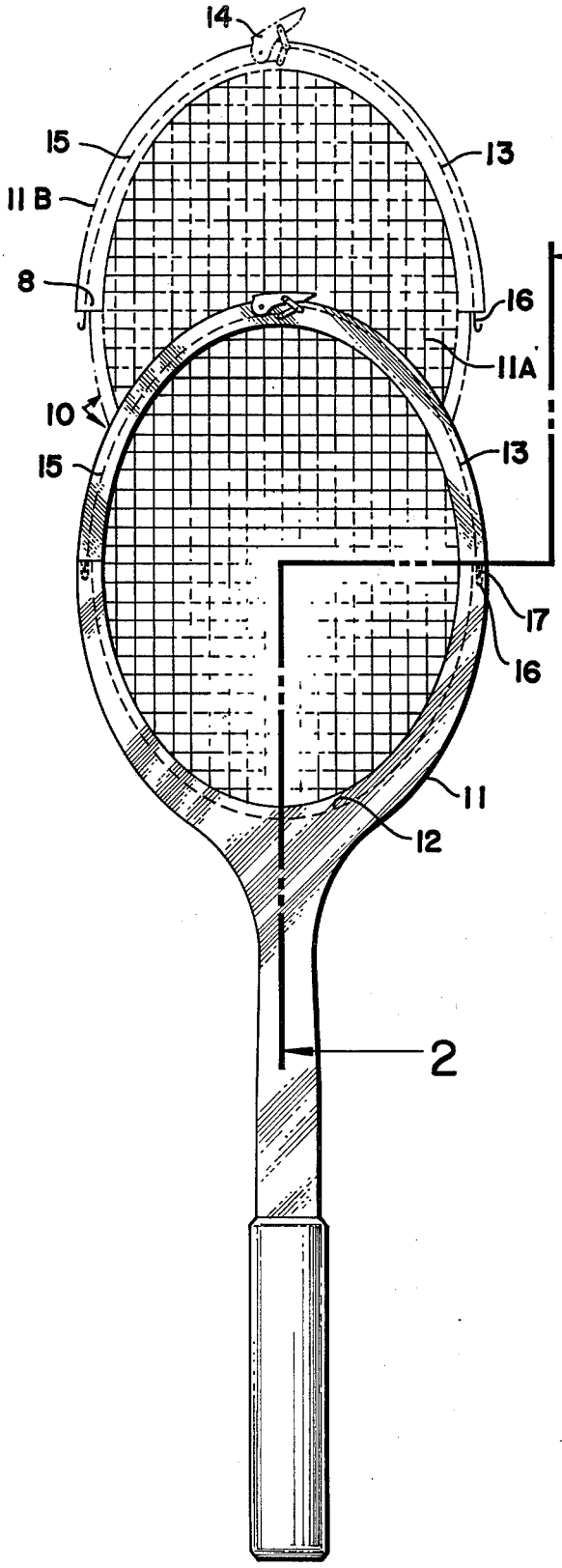
Fig. 1
Fig. 2
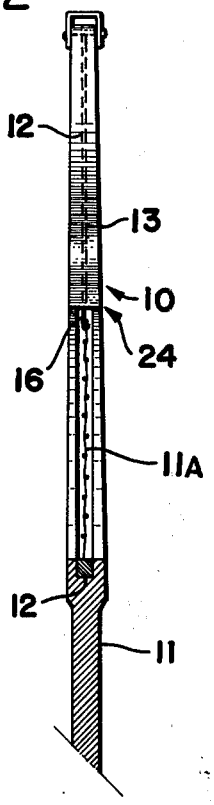
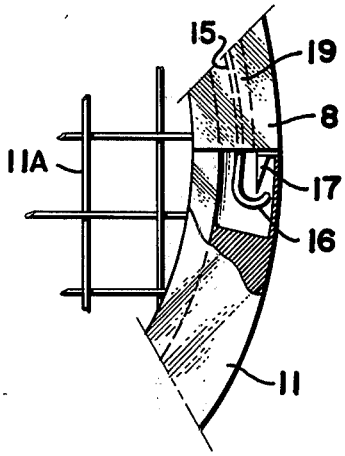
Fig. 3

TENNIS RACQUET WITH INSERT

RELATED APPLICATIONS

The present application is a Continuation-In-Part of U.S. Pat. application Ser. No. 567,922, filed Apr. 14, 1975, now abandoned.

BACKGROUND OF THE INVENTION (1) Field of The Invention

The present invention relates to the field of sporting goods, more specifically to racquets for tennis and other like games.

(2) Description of the Prior Art:

U.S. Pat. No. 3,707,288 teaches a racquet having a removable playing surface secured to a frame member by screws which require a coin or tool for tightening. U.S. Pat. No. 2,004,609 shows a somewhat similar racquet having a removable playing surface held in place by several screws which can be tightened with a key. U.S. Pat. No. 1,832,298 teaches a tennis racquet having a demountable handle or shank.

None of the above prior art teaches a tennis racquet having a removable and interchangeable playing surfaces which are secured readily without the use of any tools.

SUMMARY OF THE INVENTION (1) General Statement of The Invention

According to the present invention, demountable, replaceable and interchangeable playing surfaces are provided in a tennis racquet or the like.

(2) Utility of The Invention

The present invention provides a tennis or similar racquet insert which can be removably secured within a solid one-piece tennis racquet frame. The invention provides a tennis racquet insert which enables a tennis player to switch between gut and nylon or other cord types, simply by substituting one racquet insert for another. The invention avoids the discomfort previously experienced with split racquets of the prior art. The racquets of the invention can be simple in design, inexpensive to manufacture, rugged in construction, and efficient in operation, requiring no tools for interchange of or securing of playing surfaces.

DESCRIPTION OF THE DRAWINGS

FIG. 1 is a plan view of the present invention showing the insert (in phantom lines) as it is partially removed from the racquet head.

FIG. 2 is a cross-sectional view taken along lines 2–2 of FIG. 1.

FIG. 3 is an enlarged fragmentary plan view showing the hooking engagement of a lug on the insert with retractable hooking means within the frame of the racquet.

DESCRIPTION OF THE PREFERRED EMBODIMENTS OF THE RACQUET

Figure 4:
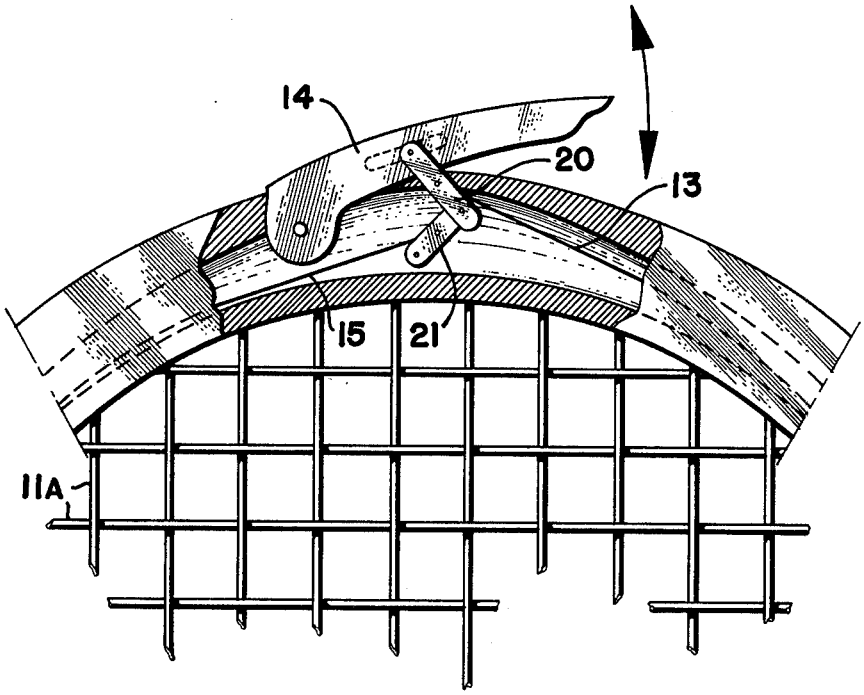
FIG. 4 is an enlarged fragmentary cut-away view showing a typical spring lever for use with the invention.

Referring to FIG. 1, tennis racquet insert 10 is shown as including a cord mesh 11A and a rim portion 11B consisting of a hollow channel received removably within groove 12 of the head 11 of the racquet. The flange portion 8 of insert 10 when inserted, abuts with the ends of head 11. A spring lever 14 mounted flush within the tennis racquet insert 10 provides locking and unlocking means for insert 10 by retracting and extending hooks 16. The spring lever 14 is connected to wires 13 and 15 running within the hollow channel of insert 10. Wires 13 and 15 are terminated by the extending hooks which engage the retaining lugs 17 secured fixedly within the head 11 of the racquet frame. The spring lever pivots to cause extending and retracting of the wire 13 which terminates in retaining hooks 16.

Alternately, the spring lever means, wire portion and hooks can all be mounted on the frame member and the retaining lugs can be mounted on the removable insert.

In operation, the pivotal spring lever 14 is merely opened extending the wires 13 and 15 through slanted guide 19 to disengage hooks 16 from lugs 17 located within the racquet frame. The insert 10 is then easily removed from the head 11 by sliding outward. A new insert having different cord material or configuration in the mesh but otherwise being similar to insert 10 can then be inserted in the racquet frame and secured after insertion by merely closing spring lever 14 to retract hooks 16.

FIG. 4 shows a typical spring lever device for use with the invention consisting of a pivoted lever 14 which is cup-shaped so that, when closed, it has recessed within it two pivoted takeup members 20 and 21. Pivoted takeup members 20 and 21 are connected, respectively, to wires 15 and 13 and serve to retract these wires when lever 14 is swung down flush with the exterior surface of the rim 11B. Many other similar take-up devices can be substituted for this particular configuration.

It should be understood that the invention is capable of a variety of modifications and variations which will be made apparent to those skilled in the art by a reading of the specification and these are to be included within the scope of the claims appended hereto.

What I now claim is:

1. A racquet having a replaceable playing surface, said racquet including a one-piece solid frame member having a handle and a head portion, said head portion being provided with an arcuate opening with groove means for receiving an insert, and a racquet insert comprising a rim with suitable playing surface secured fixedly therein, pivotable spring lever means and wire means acting with locking means to provide locking and unlocking of said insert within the head of said frame portion of the racquet.

2. The combination according to claim 1 wherein said spring lever means and wire means are located within said insert.

3. The combination according to claim 1 wherein said spring lever means and wire means are located within said frame member of said racquet.

4. The combination according to claim 1 wherein said rim of said insert is provided with hollow insert head means, said first head means including said wire means located within said head means and connected with said spring lever means, said spring lever means providing extending and contracting means for said wire means, said wire means terminating in engaging portions.

5. The combination according to claim 4 wherein said engaging portions of said wire means comprise hooks.

6. The combination according to claim 5 wherein said locking means include retaining lug means secured fixedly within the frame member of said racquet, said hooks being so disposed so as to engage said lug means whereby when said wire means are retracted, said hooks engage with said lug means so as to secure said insert.

* * * * *